US008006712B2

(12) United States Patent
Boey

(10) Patent No.: US 8,006,712 B2
(45) Date of Patent: Aug. 30, 2011

(54) FAUCET CONTROL SYSTEM AND METHOD

(76) Inventor: Kum F Boey, Monterey Park, CA (US)

( * ) Notice: Subject to any disclaimer, the term of this patent is extended or adjusted under 35 U.S.C. 154(b) by 581 days.

(21) Appl. No.: 11/925,490

(22) Filed: Oct. 26, 2007

(65) Prior Publication Data

US 2008/0099088 A1 May 1, 2008

Related U.S. Application Data

(63) Continuation-in-part of application No. PCT/US2007/070939, filed on Jun. 12, 2007.

(60) Provisional application No. 60/855,002, filed on Oct. 27, 2006, provisional application No. 60/883,970, filed on Jan. 8, 2007.

(51) Int. Cl.
*E03C 1/05* (2006.01)
*G05D 7/00* (2006.01)

(52) U.S. Cl. ..... 137/15.17; 251/129.04; 4/623

(58) Field of Classification Search ..... 137/624.11, 137/15.17, 15.18, 1; 251/129.04; 4/623
See application file for complete search history.

(56) References Cited

U.S. PATENT DOCUMENTS 4,207,466 A 6/1980 Drage et al.
4,735,357 A 4/1988 Gregory et al.
4,762,273 A 8/1988 Gregory et al.
4,823,414 A 4/1989 Piersimoni et al.
4,872,485 A 10/1989 Laverty, Jr.
4,915,347 A 4/1990 Iqbal et al.
4,972,070 A 11/1990 Laverty, Jr.
5,033,508 A 7/1991 Laverty, Jr.
5,033,715 A 7/1991 Chiang et al.
5,060,323 A 10/1991 Shaw
5,217,035 A 6/1993 Van Marcke
5,243,717 A 9/1993 Yasuo
5,322,086 A 6/1994 Sullivan
5,504,950 A 4/1996 Natalizia et al.
(Continued)

OTHER PUBLICATIONS

International Search Report issued Aug. 21, 2008, pp. 1-2.

*Primary Examiner* — Kevin L Lee
(74) *Attorney, Agent, or Firm* — Scott R. Hansen; Fulwider Patton LLP

(57) ABSTRACT

A faucet control system comprises a valve apparatus, sensors or a motion detector to be activated by a user, and a controller that controls the valve apparatus. A first sensor may start fluid flow and a second sensor may alter the proportion of fluids delivered from two fluid sources. The sensors may be activated without being touched and may include infrared and/or photodiode sensing elements. In a sink embodiment, when a user approaches the sink to wash hands, water flow is activated. Optionally, the initial water flow may be cold water, to prevent energy wastage. A second sensor may be placed elsewhere on the sink, such as on the left hand side of the faucet spout. Consequently, when the right hand, for example, is placed below the faucet spout, the water flow is activated with the first sensor. The left hand may be placed above a second sensor and, by waiving the left hand, the hand sensor will cause the hot valve to allow hot water to mix with cold water from the cold valve, should the user wish a warm temperature water flow. If the user wishes hot water, the user will then waive his or her hands over the second sensor, which will close the cold valve and open only the hot valve, thus allowing only hot water to flow from the spout.

5 Claims, 3 Drawing Sheets

U.S. PATENT DOCUMENTS 5,566,702 A 10/1996 Philipp
5,570,869 A 11/1996 Diaz et al.
5,577,660 A * 11/1996 Hansen ..... 251/129.04
5,625,908 A 5/1997 Shaw
5,694,653 A * 12/1997 Harald ..... 4/623
5,819,336 A 10/1998 Gilliam et al.
5,845,844 A 12/1998 Zosimodis
5,855,356 A * 1/1999 Fait ..... 251/129.04
5,868,311 A 2/1999 Cretu-Petra
5,915,417 A 6/1999 Diaz et al.
5,966,753 A 10/1999 Gauthier et al.
5,979,500 A 11/1999 Jahrling et al.
5,984,262 A 11/1999 Parsons et al.
6,019,130 A 2/2000 Rump
6,038,519 A 3/2000 Gauthier et al.
6,059,192 A 5/2000 Zosimadis
6,195,588 B1 2/2001 Gauthier et al.
6,219,859 B1 4/2001 Derakhshan
6,321,785 B1 * 11/2001 Bergmann ..... 251/129.04
6,549,816 B2 4/2003 Gauthier et al.
6,701,194 B2 3/2004 Gauthier et al.
6,913,203 B2 7/2005 Delangis
6,996,863 B2 2/2006 Kaneko
7,107,631 B2 * 9/2006 Lang et al. ..... 4/623
7,178,543 B2 * 2/2007 Adams ..... 137/624.11
7,232,111 B2 * 6/2007 McDaniel et al. ..... 251/129.04
7,641,173 B2 * 1/2010 Goodman ..... 251/129.04
7,766,026 B2 * 8/2010 Boey ..... 251/129.04
2009/0056011 A1 * 3/2009 Wolf et al. ..... 4/623

* cited by examiner

FAUCET CONTROL SYSTEM AND METHOD

CROSS-REFERENCES TO RELATED APPLICATIONS

This application claims the benefit of U.S. Provisional Application No. 60/855,002, filed Oct. 27, 2006, and U.S. Provisional Application No. 60/883,970, filed Jan. 8, 2007, both of which are incorporated by reference. This application is a continuation-in-part of International Application No. PCT/US2007/070939, filed Jun. 12, 2007 and which is incorporated by reference.

FIELD OF THE INVENTION

The invention relates generally to faucets, and, more particularly, to a control system and method for controlling fluid flow to faucets.

BACKGROUND OF THE INVENTION

In many settings it is desirable to have a control system that allows for convenient control of water faucets and other water delivery fixtures. Touchless control systems have been developed which allow water flow from a faucet when a person places his or her hand within range of an infrared sensor. Touchless control systems promote sanitary conditions because they eliminate the need to touch any part of the faucet. Many touchless control systems, however, lack a means for convenient adjustment of water temperature. The ability to adjust temperature is indispensable in households, hotels, hospitals, and many work places. Touchless control systems that have no temperature control can be installed to dispense only warm water, for example, but this increases energy costs when warm water is not needed. Or the system can be set to dispense only cold water, but this can be quite unpleasant during winter months. Neither setting is appropriate where sometimes cold water is desired, such as for waking up or cooling off on a hot day, but at other times hot water is required in order to kill bacteria.

Another drawback of existing faucet control systems is that installation often requires replacement of the faucet spout, which makes retrofitting of existing washrooms expensive. Retrofitting is further complicated when removal of conventional hot and water control knobs on either side of the faucet spout exposes unsightly holes on a countertop. Installing caps with no other purpose than to cover the holes is often undesirable, such as in luxury hotels and other locations where a finished appearance is important, because such caps draw attention to the fact that a retrofit was performed.

Persons skilled in the art have recognized a need for a system and method for controlling water temperature to reduce water waste, conserve energy, and promote sanitary conditions. There is also a need for a system and method which reduces the expense of retrofitting existing washrooms. There is also a need for a faucet control system and method that allows for flexibility in placement of a temperature or water flow control in order to accommodate use by a broad range of persons. The present invention satisfies these and other needs.

SUMMARY OF THE INVENTION

Briefly and in general terms, a system and method is presented for use in washing basins such as sinks, baths, showers, and the like. In one embodiment, the system has two valves, one valve connected to a cold water supply, the other connected to a hot water supply. This embodiment also has two motion sensors, such as photodiodes and/or infrared. The motion sensors detect motion, such as by hands or other parts of the human body, and alter the flow and/or water temperature when motion is detected.

In one embodiment, a first sensor is placed anywhere above the sink, such as on the right side of the spout of the sink. An electronic eye may be directed near or below the tip of the faucet spout. When a user approaches the sink to wash hands, water flow is immediately activated. Optionally, the initial water flow may be cold water, to prevent energy wastage. A second sensor may be placed elsewhere on the sink, such as on the left hand side of the faucet spout. Consequently, while the right hand, for example, is still below the faucet spout, the water flow is activated with the first sensor. The temperature of the water may be changed by, for example, waiving the left hand above the second sensor. The hot valve and cold valve, for example, may then open to allow hot and cold water to mix to create a warm temperature flow. If the user wishes hot water, the user will then waive his or her hands over the second sensor again, which will close the cold valve and open only the hot valve, thus allowing only hot water to flow from the spout.

The system may be made more versatile, to facilitate a wider range of temperatures, by incorporating a microchip into the system, and/or by adding further valves. For instance, the system may have four valves, two valves for hot water and two valves for cold water. In this embodiment, five temperatures are achieved using the four valves. The temperatures change as follows. For entirely cold water, the two cold valves are opened. For slightly warmer water, two cold valves and one hot valve are opened. For warm water, two cold valves and two hot valves are opened. For warmer water, one cold valve and two hot valves are opened. Then, for very hot water, two hot valves are opened, resulting in hot water flow. Hence, in this embodiment, the second sensor controls the opening of each of the four valves, depending on the water temperature desired.

The foregoing relates only to one embodiment, and many variations fall within the scope of the invention.

The system may be entirely motion activated, or may optionally include a timer to shut off flow after a given period of time. The system is versatile, in that it may be used not only on sinks, but alternatively on showers and baths.

Considering another embodiment, the present invention is directed to a faucet control system for and method of controlling fluid flow to a faucet spout in fluid communication with at least one fluid source. The system comprises a cold valve adapted to control fluid flow from a cold fluid source to the faucet spout, a first sensor that is motion activated by a user of the system, and controller. The controller may include an optional timer in communication with the cold valve and the first sensor. The controller is configured to open the cold valve when the first sensor is activated, thereby allowing fluid flow from the cold fluid source to the faucet spout, and to close the cold valve after a first selected period of time after the first sensor is deactivated, thereby preventing fluid flow from the cold fluid source to the faucet spout after the first selected period of time. In other aspects of the present invention, the controller includes an adjustment knob for adjusting the first selected period of time.

In further aspects of the present invention, the system comprises a hot valve adapted to control fluid flow from a hot fluid source to the faucet spout, and a second sensor is activated by the user with hand motion, wherein the controller is in communication with the hot valve and the second sensor. In these aspects, the controller is configured to open the hot valve when the second sensor is activated, thereby allowing fluid flow from the hot fluid source to the faucet spout, and to close the hot valve after a second selected period of time after the second sensor is deactivated, thereby preventing fluid flow from the hot fluid source to the faucet spout after the second selected period of time.

In one embodiment, the first fluid is a relatively colder fluid, and the second fluid is a relatively hotter fluid. The "colder" or "cold" fluid may be at room temperature but is significantly cooler than the "hotter" or "hot" fluid.

The present invention is also directed to a faucet control system for controlling fluid flow to a faucet spout in fluid communication with a cold fluid source delivering a cold fluid and a hot fluid source delivering a hot fluid. The system comprises a valve apparatus having an outlet connectable to the faucet spout, a first inlet connectable to the cold fluid source, and a second inlet connectable to the hot fluid source, a first motion sensor that is activated by a user of the system, a second motion sensor that is activated by the user and provides a sensor signal when activated, and a controller in communication with the valve apparatus, the first sensor, and the second sensor, the controller controls the valve apparatus to allow a proportion of the cold fluid to the hot fluid is delivered to the faucet spout when the first sensor is activated, and to alter the proportion when the second sensor is activated.

In detailed aspects of the present invention, the valve apparatus includes a cold valve adapted to be connected to the cold fluid source and a hot valve adapted to be connected to the hot fluid source. In these detailed aspects, the controller controls the cold valve and the hot valve such that a first proportion of the cold fluid to the hot fluid is delivered to the faucet spout when the second sensor provides an initial sensor signal. The controller also controls the cold valve and the hot valve such that a second proportion of the cold fluid to the hot fluid is delivered to the faucet spout when the second sensor provides a first subsequent sensor signal after the initial sensor signal, the second proportion being different than the first proportion. The controller further controls the cold valve and the hot valve such that a third proportion of the cold fluid to the hot fluid is delivered to the faucet spout when the second sensor provides a second subsequent sensor signal after the first subsequent sensor signal, the third proportion being different than the first proportion and the second proportion.

In more detailed aspects, the cold valve opens when power is provided to the cold valve, the hot valve opens when power is provided to the hot valve, and the controller includes a first relay, a second relay, and a third relay. The first relay provides power to the cold valve when the second sensor provides an initial sensor signal. The second relay provides power to the cold valve and the hot valve when the second sensor provides a first subsequent sensor signal after the initial sensor signal. The third relay provides power to the hot valve when the second sensor provides a second subsequent sensor signal after the first subsequent sensor signal.

In other aspects, the first sensor is adapted to be mounted at a location spaced apart from the faucet spout and includes a sensing element having a sensing range, and the first sensor activates when the hand of the user is within the sensing range. In further aspects, the sensing element of the first sensor is oriented such that the sensing range of the sensing element is below the faucet spout and the first sensor.

In yet other aspects, the second sensor is adapted to be mounted at a location spaced apart from the faucet spout and includes a sensing element having a sensing range, and the second sensor activates when the hand of the user is within the sensing range. In further aspects, the sensing element of the second sensor is oriented such that the sensing range of the sensing element is above the second sensor.

A method comprises connecting the first inlet of a cold valve to the cold fluid source, connecting the first outlet of the cold valve to the faucet spout, connecting the second inlet of a hot valve to the hot fluid source, connecting the second outlet of the hot valve to the faucet spout, adhering a motion sensor for activating the cold valve and the hot valve on a structure and at a location that is accessible to a user, and making hand motions to open one or both of the cold valve and the hot valve.

The present invention is also directed to a method comprising connecting an outlet of a valve apparatus to the faucet spout, connecting a first inlet of a valve apparatus to the cold fluid source, connecting a second inlet of the valve apparatus to the hot fluid source, mounting a first sensor at a first location spaced apart from the faucet spout, mounting a second sensor at a second location spaced apart from the faucet spout, activating the first sensor without touching the first sensor to allow a proportion of the cold fluid to the hot fluid to be delivered to the faucet spout, and activating the second sensor without touching the second sensor to alter the proportion of the cold fluid to the hot fluid.

In detailed aspects of the present invention, mounting the first sensor includes orienting a sensing element of the first sensor such that a sensing range of the sensing element is located below the first sensor and the faucet spout. In other detailed aspects, mounting the second sensor includes orienting a sensing element of the second sensor such that a sensing range of the sensing element is located above the second sensor.

Generally, it is noted that the terms "hot valve" and "cold valve" do not relate to the temperature of the valves. Rather, these terms indicate which water source the valve control, either the relatively hotter water or the relatively colder water.

The features and advantages of the invention will be more readily understood from the following detailed description which should be read in conjunction with the accompanying drawings.

DETAILED DESCRIPTION OF THE PREFERRED EMBODIMENTS

Figure 1:
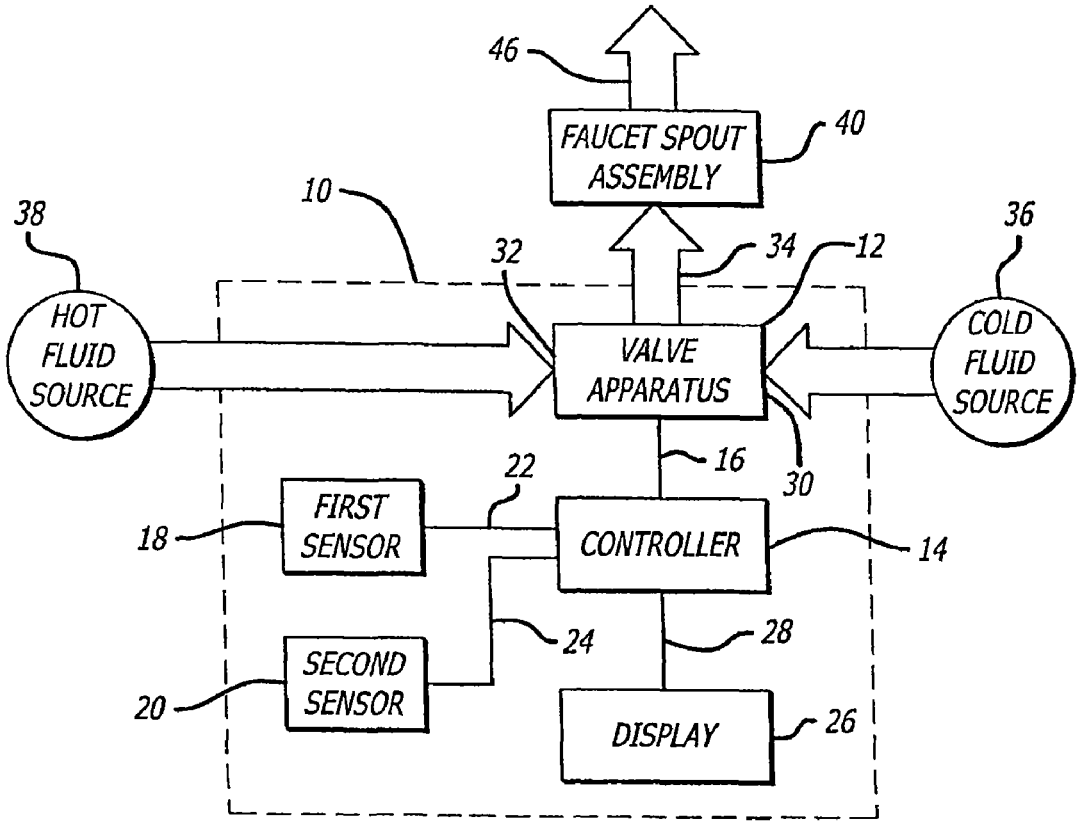
FIG. 1 is a block diagram of a faucet control system showing a valve apparatus, a controller, a first sensor, a second sensor, and a display.

Referring now in more detail to the exemplary drawings for purposes of illustrating embodiments of the invention, wherein like reference numerals designate corresponding or like elements among the several views, there is shown in FIG. 1 a block diagram of a faucet control system 10 having a valve apparatus 12 controlled by a controller 14 that provides a valve control signal 16 to the valve apparatus. The faucet control system also has a first sensor 18 and a second sensor 20 that provide a first sensor signal 22 and a second sensor signal 24, respectively, to the controller. The faucet control system further has a visual display 26 for indicating temperature information in response to a display signal 28 from the controller.

The valve apparatus 12 has a cold fluid inlet 30, a hot fluid inlet 32, and a fluid outlet 34. A cold fluid source 36 and a hot fluid source 38 are in fluid communication with the cold and hot fluid inlets, respectively. A faucet spout assembly 40 is in fluid communication with the outlet 34. In the embodiment shown, the cold and hot fluid sources and the faucet spout assembly are separate from the faucet control system 10.

Still referring to FIG. 1, the valve apparatus 12 allows a desired proportion of cold to hot fluid from fluid sources 38, 36 to be delivered to faucet spout assembly 40. As described in more detail below, the delivery of the desired proportion of cold to hot fluid is prescribed by a user of the faucet control system 10 by activating the first and second sensors 18, 20. For example, the user may desire that fluid exiting the faucet outlet 46 come from (i) only the cold fluid source 36, (ii) from both the cold and hot fluid sources 36, 38, or (iii) only from the hot fluid source 38. The first and second sensors 18, 20 are adapted to detect the presence of an object radiating thermal energy, such as the user's hand, within range of the sensors. The first sensor 18 is used to determine when fluid is delivered to faucet spout assembly. The second sensor 20 is used to adjust the temperature of the fluid exiting the faucet outlet 46, that is, the proportion of cold to hot fluid exiting the faucet outlet.

Figure 2:
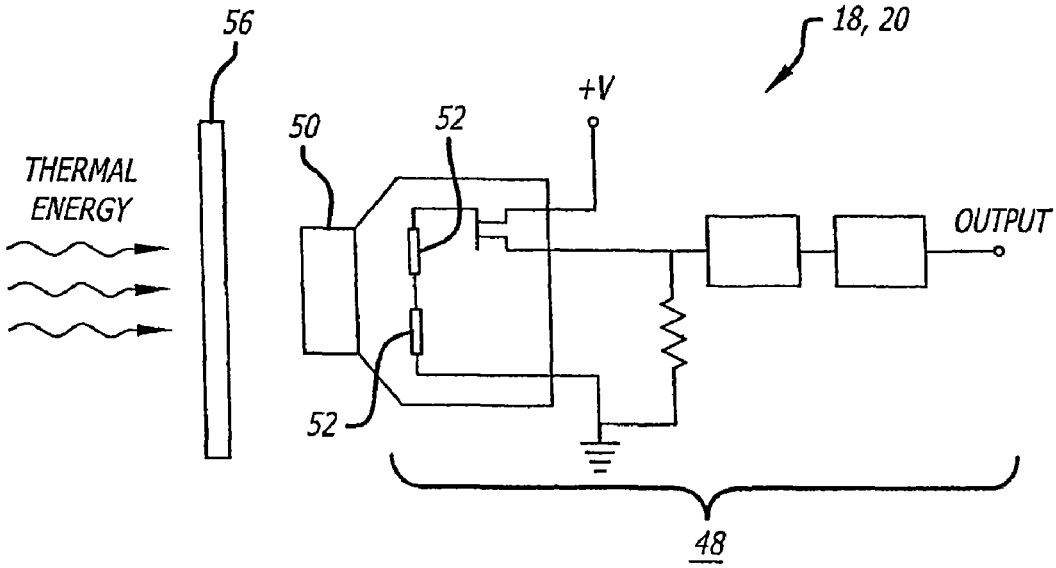
FIG. 2 is a schematic diagram of the first and second sensors of FIG. 1 showing a pyroelectric sensor, an IR filter, and a focusing device.

Referring now to FIG. 2, the first and second sensors 18, 20 preferably utilize electromagnetic radiation such that the user need not touch the sensors. In this way, sanitary conditions around the faucet are maintained. The first and second sensors may include an infrared (IR) motion detector, such as a pyroelectric sensor 48. The pyroelectric sensor includes a crystalline material that generates a surface electric charge when exposed to thermal energy or heat in the form of infrared radiation. When the amount of radiation striking the crystal changes, the amount of charge also changes and can then be measured with a sensitive field-effect transistor (FET) device built into the pyroelectric sensor. The first and second sensors 18, 20 may further include a filter window or IR filter 50 to limit the radiation that reaches the pyroelectric sensor to a preselected wavelength range, such as 8 to 14 micrometers, which is most sensitive to the heat generated by a human body. In other embodiments, the first sensor 18, the second sensor 20, or both may include a photodiode. Such a photodiode may be used with a mirror and light transmitter.

Figure 3:
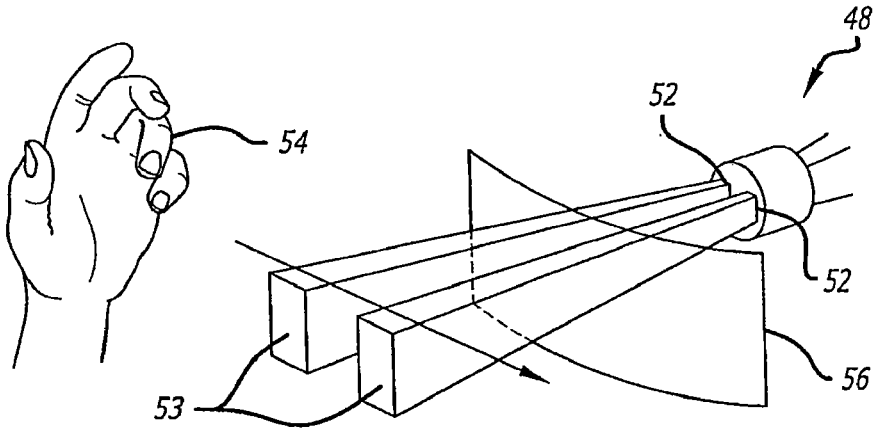
FIG. 3 is a perspective view of the pyroelectric sensor of FIG. 2 showing two sensing elements for detecting motion of a hand progressively passing through the individual detecting areas of the sensing elements.

As shown in FIG. 3, the pyroelectric sensor 48 may include two sensing elements 52, each having a separate detecting area 53. This arrangement cancels signals caused by vibration, temperature changes, and sunlight. A hand 54 passing in front of the sensor will activate first one and then the other sensing element whereas other sources will affect both elements simultaneously and be cancelled. Referring to FIGS. 2 and 3, the first and second sensors 18, 20 may also include a focusing device 56, such as a Fresnel lens, which is a type of plano convex lens that has been collapsed on itself to form a flat lens that retains its optical characteristics but is much smaller in thickness and therefore has less absorption loss. The focusing device may be made of an infrared transmitting material that has a preselected IR transmission range of 8 to 14 micrometers. A suitable example without limitation of a pyroelectric sensor is the PIR325 manufactured by Golab Corporation (Wappingers Falls, N.Y.).

Figure 4:
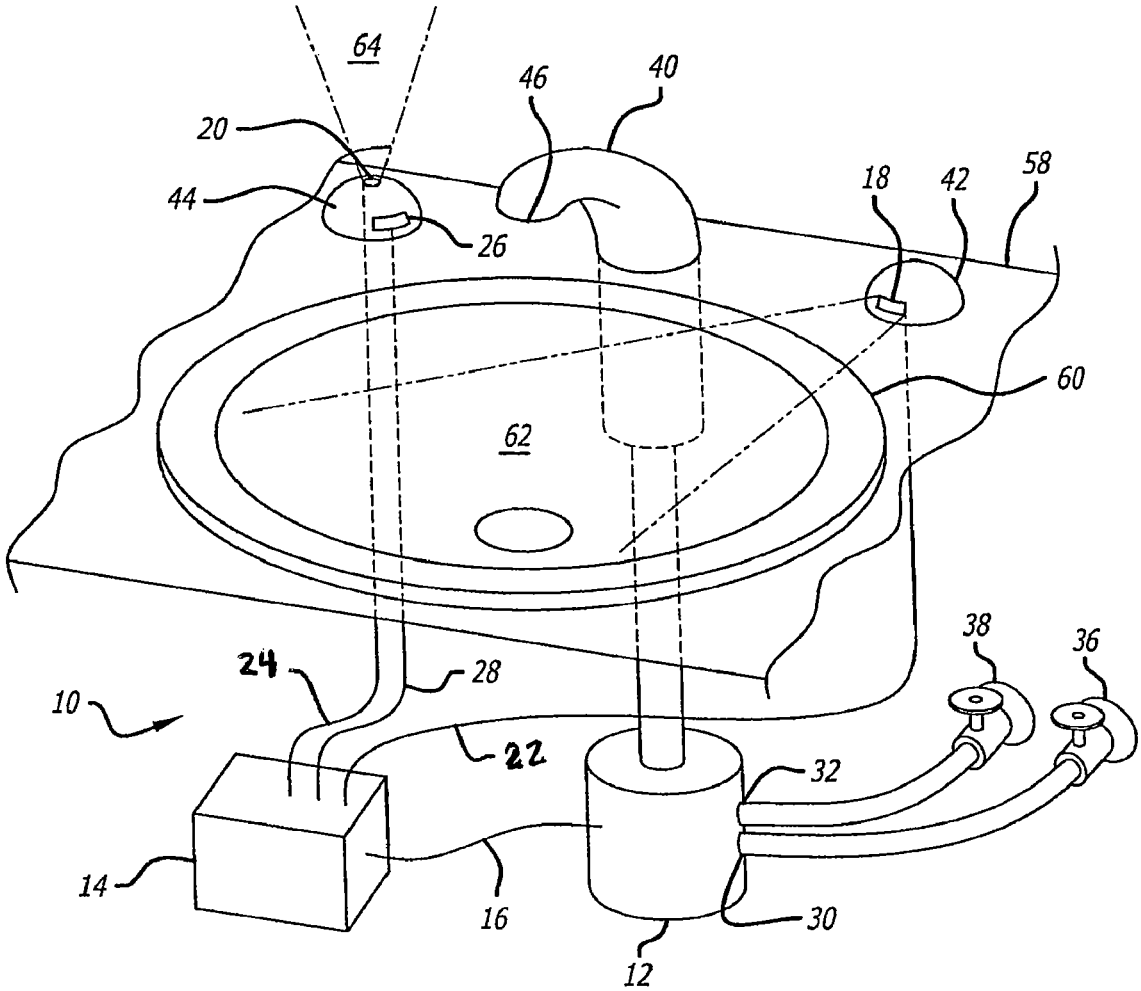
FIG. 4 is a perspective view of the faucet control system of FIG. 1 showing the first sensor located on a first cover mounted on a counter top, the second sensor and display located on a second cover mounted on the counter top, a cold water inlet of the valve apparatus coupled to a cold water valve on a facility wall, and a hot water inlet of the valve apparatus coupled to a hot water valve on the facility wall.

Turning now to FIG. 4, there is shown an embodiment of a faucet control system 10 adapted to a bathroom or lavatory faucet assembly 40 on a countertop 58 adjacent a sink 60. The conventional faucet valves for hot and cold water have been removed from the countertop. Conveniently, the holes in the countertop where the faucet valves were once located are used to mount a first cover 42 and second cover 44. The first sensor 18 is located on the first cover so that the first sensor is able to detect the user's hand under the faucet outlet 46 of the faucet spout assembly. The second sensor 20 is located on the second cover so that the second sensor is able to detect the user's hand above second cover. The display 26 is also located on the second cover. Any photodiodes, light transmitters, or mirrors associated with the first and second sensors 18, may be housed within the first and second covers 42, 44, respectively. In this way, the faucet control system can be adapted or fitted to an existing faucet without having to replace the faucet and drill holes in the sink or countertop. It is to be understood that the faucet control system 10 can be adapted to other types of faucets and the position of the sensors 18, 20 can be varied so that the first sensing range 62 is in front of the faucet outlet 46 and the second sensing range 64 is at another area near the faucet. Examples of other types of faucets without limitation include wall-mounted faucets, kitchen faucets, and faucets for bath tubs. It will be understood that the location of the first and second sensors on the first and second covers may vary depending on the type of faucet.

When the first sensor 18 detects the presence or motion of the user's hand within its sensing range 62, the first sensor provides the first sensor signal 22 indicating the presence of the hand to the controller 14. The sensing range 62 is the area beneath the faucet outlet 46 and is indicated by phantom lines in the sink 60 shown in FIG. 4. In response to the first sensor signal, the controller provides a first control signal 16A to the valve apparatus 12 so that a default proportion of cold to hot water begins to be delivered by valve apparatus to the faucet spout assembly 40. The first control signal 16A provided to the valve apparatus 12 may be an electrical current sufficient to actuate a motor or solenoid in the valve apparatus. The default proportion may be set so that only cold water is delivered to the faucet spout assembly when the first sensor initially detects the hand within its sensing range. Of course, the default proportion may also be set so that a particular mixture of cold and hot water is delivered or only hot water is delivered. When the hand is removed from the sensing range of the first sensor, the first sensor signal 22 is discontinued or altered. In response to cessation or alteration of the first sensor signal, the controller provides another first control signal 16B to the valve apparatus 12 so that water delivery to the faucet spout assembly is terminated. The second control signal 16B may be cessation of the electrical current being supplied to a motor or solenoid in the valve apparatus. The controller may be preprogrammed or configured to terminate water delivery after a predetermined time, such as a few seconds, after the hand is removed from the sensing range of the first sensor.

While water is being delivered to the faucet spout assembly 40, the user may move her hand momentary within the sensing range 64 of the second sensor 20. The sensing range 64 is the area above the second sensor and is indicated by phantom lines shown in FIG. 4. When the second sensor detects the presence or motion of the user's hand, the second sensor provides a second sensor signal 24 to the controller 14. In response to the second sensor signal, the controller provides a second control signal to the valve apparatus 12 so as to progressively alter the proportion, ratio, or mixture of cold to hot water being delivered. For example, the user may wave her hand over the second sensor so that the water coming out of the faucet outlet 46 changes from only cold water to a first mixture of cold and hot water. The user may wave her hand over the second sensor again so that the water coming out of the faucet outlet changes from the first mixture to a second mixture having a greater proportion of hot water. The user may wave her hand over the second sensor yet again so that the water coming out of the faucet outlet changes to only hot water. The controller may be preprogrammed or configured so that if the user waves her hand over the second sensor a further time, the sequence starts over so that the water coming out of the faucet outlet changes to only cold water. As a further alternative, the system may have four valves, two valves for hot water and two valves for cold water. In this embodiment, five temperatures are achieved using the four valves. The temperatures change as follows. For entirely cold water, the two cold valves are opened. For slightly warmer water, two cold valves and one hot valve are opened. For warm water, two cold valves and two hot valves are opened. For warmer water, one cold valve and two hot valves are opened. Then, for very hot water, two hot valves are opened, resulting in hot water flow. Hence, in this embodiment, the second sensor controls the opening of each of the four valves, depending on the water temperature desired.

Still referring to FIG. 4, the display 26 is located on the second cover 26 so that it is visible to the user of the faucet spout assembly 40. The display is configured to indicate the proportion of cold to hot water that the valve apparatus 12 is delivering to the faucet spout assembly. The display may include an alphanumeric display or a plurality of lights or light emitting diodes (LEDs) that are controlled by the display signal 28 provided by the controller 14. For example, the display may show the numeral one or illuminate one LED to indicate that only cold water is being delivered the faucet spout assembly. The display may show the numeral two or show two LEDs illuminated to indicate that the first mixture of cold and hot water is being delivered. Continuing further, the display may show the numeral three or illuminate three LEDs to indicate that the second mixture of water having a higher proportion of hot water is being delivered. Finally, the display may show the numeral four or illuminate four LEDs to indicate that only hot water is being delivered.

Referring again to FIGS. 1 and 4, the valve apparatus 12 may include one or more valves. For example, the valve apparatus may include one variably adjustable ball valve and a motor for moving the ball valve. The mixture of cold and hot fluid at any instant corresponds to the rotational position of the ball valve, which depends on the valve control signal 16 received by the valve apparatus from the controller 14. Other types of variably adjustable valves may also be used. The valve apparatus may include two or more solenoid valves.

Figure 5:
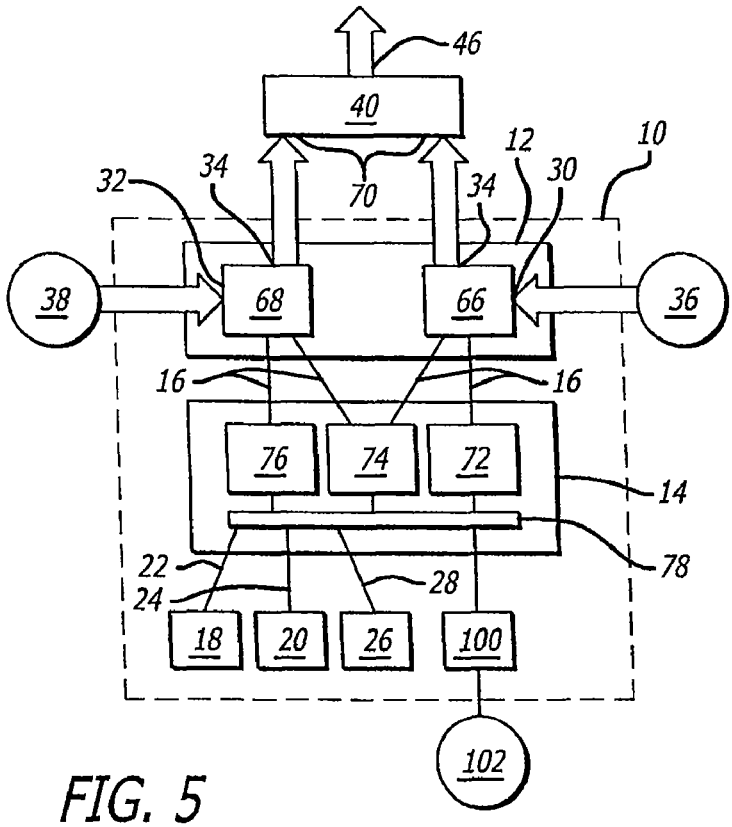
FIG. 5 is a block diagram of a faucet control system showing a valve apparatus having two valves controlled by a controller having a first relay device, second relay device, third relay device, and a circuit board.

Turning to FIG. 5, there is shown a block diagram a faucet control system 10 having a valve apparatus 12 that includes a cold valve 66 and a hot valve 68 that are adapted to control delivery of cold and hot fluid respectively. The cold valve has a cold fluid inlet 30 adapted to be coupled to a cold water source 36. The hot valve has a hot fluid inlet 32 adapted to be coupled to a hot water source 38. The first and hot valves each have a separate fluid outlet 34 adapted to be coupled to one of two fluid inlets 70 of the faucet spout assembly 40. The faucet spout assembly combines fluid entering the inlets 70 into one stream of fluid exiting a single faucet outlet 46. The first and hot valves are moveable between a normally closed state and an actuated open state in response to valve control signals 16 provided by the controller 14. The cold and hot valves may include solenoids, motors, or other means of actuating an interior movable valve member to a fully open, partially closed, or fully closed position in response to valve control signals 16 provided by the controller 14.

Still referring to FIG. 5, the controller 14 includes a first relay device 72, a second relay device 74, a third relay device 76, and a circuit board 78. The relay devices 72, 74, 76 provide separate valve control signals 16 to the cold and hot valves 66, 68. The circuit board receives a first sensor signal 22 from the first sensor 18, receives a second sensor signal 24 from the second sensor 20, and provides a display signal 28 to the display 26. The circuit board may include a microprocessor and other electronic components for separately activating and deactivating the relay devices 72, 74, 76 in response to the received sensor signals 22, 24. The circuit board obtains power from a transformer 100 connected to a power source 102, such as a standard AC electrical outlet providing alternating current.

When the user momentarily places her hand within range of the first sensor, a first sensor signal 22 is provided to the circuit board 78. When the user places her hand within range of the second sensor 20, a second sensor signal 24 is provided to the circuit board 78. In response to either the first or second sensor signal, the circuit board activates the first relay device 72, which in turn provides a valve control signal 16 to only the cold valve 66. As a result, the cold valve is moved from the normally closed to the open state so that cold water from the cold water source 36 is delivered to the faucet spout assembly 40. The hot valve 68 remains in its normally closed state so that only cold water exits the faucet outlet 46.

When the user momentarily places her hand within range of the second sensor 20 for a second time, another second sensor signal 24 is provided to the circuit board 78. Through programming of a microprocessor using appropriate software or embedded commands or through other means, the circuit board activates the second relay device 74, which in turn provides a valve control signal 16 to both the cold valve 66 and the hot valve 68. As a result, the cold valve remains in the open state and the hot valve is moved from the normally closed state to the open state. In this way, cold and hot water from the cold and hot water sources 36, 38 are delivered to the faucet spout assembly 40 so that warm water exits the faucet outlet 46. Preferably, water continues to be delivered to the faucet spout assembly 40 while the user's hand remains within the first sensing range 62 of the first sensor 18, even after the user's hand has moved out of the second sensing range 64 of the second sensor 20.

With continued reference to FIG. 5, when the user momentarily places her hand within range of the second sensor 20 for a third time, yet another second sensor signal 24 is provided to the circuit board 78. The circuit board activates the third relay device 76, which in turn provides a valve control signal 16 to only the hot valve 68. As a result, the hot valve remains in the open state while the cold valve 66 returns to its normally closed state. In this way, only hot water from the hot water source 38 is delivered to the faucet spout assembly 40 so that hot water exits the faucet outlet 46. The circuit board 78 may be programmed or configured such that either cold or warm water exits the faucet outlet 46 after the user waves her hand within range of the second sensor 20 for a fourth time.

Figure 6:
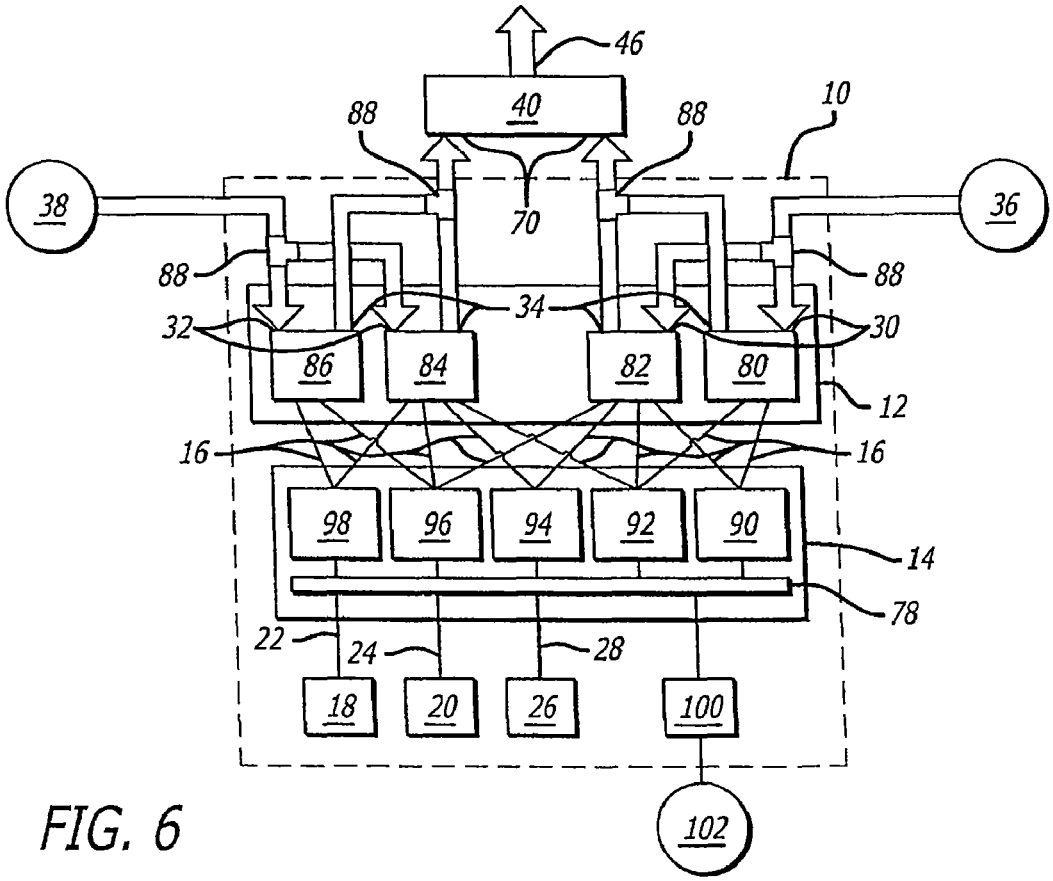
FIG. 6 is a block diagram of a faucet control system showing a valve apparatus with four valves controlled by a controller having five relay devices.

Greater control of the temperature of the water exiting the faucet outlet 46 would be achieved, for example, with the use of additional valves or relay devices. In FIG. 6 there is shown a block diagram of a faucet control system 10 having a valve apparatus 12 that includes four valves 80, 82, 84, 86 which control delivery of cold and hot fluid. The first and hot valves 80, 82 each have a cold fluid inlet 30 adapted to be coupled to a cold water source 36 by means of a T-connector 88. The third and fourth valves 84, 86 each have a hot fluid inlet 32 adapted to be coupled to a hot water source 38 by means of another T-connector 88. The four valves each have a separate fluid outlet 34 adapted to be coupled to one of two fluid inlets 70 of the faucet spout assembly 40. In the embodiment shown, the outlets of the first and hot valves are joined by a T-connector 88 that leads to one of the two fluid inlets 70 of the faucet spout assembly. The outlets of the third and fourth valves are joined by another T-connector 88 that leads to the other fluid inlet 70.

The faucet spout assembly 40 combines fluid entering the inlets 70 into one stream of fluid exiting a single faucet outlet 46. Each of the four valves 80, 82, 84, 86 are moveable between a normally closed state and an actuated open state in response to valve control signals 16 provided by the controller 14. Each of the four valves may include solenoids, motors, and other means of actuating an interior movable valve member to a fully open, partially closed, or fully closed position in response to valve control signals 16 provided by the controller 14.

Still referring to FIG. 6, the controller 14 includes a five relay devices 90, 92, 94, 96, 98 and a circuit board 78. Each of the relay devices provides separate valve control signals 16 to the valves 80, 82, 84, 86 as explained in greater detail below. The circuit board 78 receives a first sensor signal 22 from the first sensor 18, receives a second sensor signal 24 from the second sensor 20, and provides a display signal 28 to the display 26. The circuit board may include a microprocessor and other electronic components for separately activating and deactivating the relay devices in response to the received sensor signals 22, 24. The circuit board obtains power from a transformer 100 connected to a power source 102.

With continued reference to FIG. 6, when the user waves her hand within range of the second sensor 20, a second sensor signal 24 is momentarily provided to the circuit board 78. In response the circuit board activates the first relay device 90, which in turn provides a valve control signal 16 to the first and hot valves 80, 82. As a result, the first and hot valves are moved from the normally closed state to the open state so that cold water from the cold water source 36 is delivered to the faucet spout assembly 40. The third and fourth valves 84, 86 remain in their normally closed state so that only cold water exits the faucet outlet 46.

Preferably, water continues to be delivered to the faucet spout assembly 40 while the user's hand remains within the first sensing range 62 of the first sensor 18, even after the user's hand has moved out of the second sensing range 64 of the second sensor 20.

When the user waves her hand within range of the second sensor 20 for a second time, a second sensor signal 24 is again momentarily provided to the circuit board 78. Through programming of a microprocessor or other means, the circuit board deactivates the first relay device 90 and activates the second relay device 92, which in turn provides a valve control signal 16 the first, second, and third valves 80, 82, 84. As a result, the first and hot valves 80, 82 remain in the open state and the third valve 84 is moved from the normally closed state to the open state. In this way, a two-to-one mixture of cold to hot water is delivered to the faucet spout assembly 40 so that slightly warm water exits the faucet outlet 46.

When the user waves her hand within range of the second sensor 20 for a third time, a second sensor signal 24 is yet again momentarily provided to the circuit board 78. The circuit board deactivates the second relay device 92 and activates the third relay device 94, which in turn provides a valve control signal 16 to only the second and third valves 82, 84. As a result, the cold valve 80 returns to its normally closed state and second and third valves remain in the open state. In this way, a one-to-one ratio of cold to hot water is delivered to the faucet spout assembly 40 so that warm water exits the faucet outlet 46.

When the user waves her hand within range of the second sensor 20 for a fourth time, a second sensor signal 24 is again momentarily provided to the circuit board 78. The circuit board deactivates the third relay device 94 and activates the fourth relay device 96, which in turn provides a valve control signal 16 the second, third, and fourth valves 82, 84, 86. As a result, the second and third valves 82, 84 remain in the open state and the fourth valve 86 is moved from the normally closed state to the open state. In this way, a one-to-two ratio of cold to hot water is delivered to the faucet spout assembly 40 so that slightly warm water exits the faucet outlet 46.

When the user waves her hand within range of the second sensor 20 for a fifth time, a second sensor signal 24 is momentarily provided to the circuit board 78. The circuit board deactivates the fourth relay device 96 and activates the fifth relay device 98, which in turn provides a valve control signal 16 to only the third and fourth valves 84, 86. As a result, the hot valve 82 returns to its normally closed state and third and fourth valves remain in the open state. In this way, only hot water from the hot water source 38 is delivered to the faucet spout assembly 40.

It should be noted that while the foregoing discusses an embodiment that is a sink, the touchless temperature control system may be extended to showers and/or bathtubs, as well as other applications. In a shower, for example, the touchless temperature controls would replace the manually turning handles normally used.

As a further alternative, a photodiode system may be used in place of an infrared system. Photodiode systems are useful in applications in which the faucet turns off in response to motion rather than to a timer. A motion-controlled water shut-off system cuts down further on water usage. Photodiode systems are particularly well suited for motion-controlled shutoff, although systems using other types of sensors may also be made to be motion-controlled rather than timer controlled, or may be both motion-controlled and timed. In a motion-controlled system, when the user removes his or her hands, for example, water flow shuts off without a timer. But for heavy water use applications, such as bathtubs and showers, a timer is preferred to ensure that the water flow cuts off after a predetermined time.

While several particular forms of the invention have been illustrated and described, it will also be apparent that various modifications can be made without departing from the scope of the invention. It is also contemplated that various combinations or subcombinations of the specific features and aspects of the disclosed embodiments can be combined with or substituted for one another in order to form varying modes of the invention. Accordingly, it is not intended that the invention be limited, except as by the appended claims.

I claim:

1. A method of controlling fluid flow to a faucet spout in fluid communication with a cold fluid source delivering a cold fluid and hot fluid source delivering a hot fluid, the method comprising:

connecting an outlet of a valve apparatus to the faucet spout;

connecting a first inlet of a valve apparatus to the cold fluid source;

connecting a second inlet of the valve apparatus to the hot fluid source;

mounting a first sensor that includes a photodiode at a first location spaced apart from the faucet spout;

mounting a second sensor that includes a photodiode at a second location spaced apart from the faucet spout;

activating the first sensor without touching the first sensor to allow a proportion of the cold fluid to the hot fluid to be delivered to the faucet spout; and activating the second sensor without touching the second sensor to alter the proportion of the cold fluid to the hot fluid;

wherein the method further comprises waving a hand over the second sensor to alter fluid flow from cold fluid to warm fluid;

waving a hand over the second sensor again to alter fluid flow from warm fluid to hot fluid; and waving a hand over the second sensor yet again to alter fluid flow from hot fluid to cold fluid.

2. The method of claim 1 wherein mounting the first sensor includes orienting a sensing element of the first sensor such that a sensing range of the sensing element is located below the first sensor and the faucet spout.

3. The method of claim 1 wherein mounting the second sensor includes orienting a sensing element of the second sensor such that a sensing range of the sensing element is located above the second sensor.

4. The method of claim 1 wherein the method includes activating one of the first sensor and second sensor without touching the first sensor to shut off flow of fluid through the faucet spout.

5. The method of claim 1 wherein the method includes mounting said first and second sensors on respective first and second covers, the first and second covers being mounted in respective holes in a countertop where faucet valves were previously located.

* * * * *